US009367010B2

(12) United States Patent
Takagi et al.

(10) Patent No.: US 9,367,010 B2
(45) Date of Patent: Jun. 14, 2016

(54) FIXING DEVICE AND IMAGE FORMING DEVICE

(71) Applicants: Hiromasa Takagi, Tokyo (JP); Masahiko Satoh, Tokyo (JP); Masaaki Yoshikawa, Tokyo (JP); Kenji Ishii, Kanagawa (JP); Hiroshi Yoshinaga, Chiba (JP); Tadashi Ogawa, Tokyo (JP); Takahiro Imada, Kanagawa (JP); Kazuya Saito, Kanagawa (JP); Naoki Iwaya, Tokyo (JP); Toshihiko Shimokawa, Kanagawa (JP); Kensuke Yamaji, Kanagawa (JP); Teppei Kawata, Kanagawa (JP); Takamasa Hase, Shizuoka (JP); Shuutaroh Yuasa, Kanagawa (JP); Takuya Seshita, Kanagawa (JP); Takeshi Uchitani, Kanagawa (JP); Arinobu Yoshiura, Kanagawa (JP); Hajime Gotoh, Kanagawa (JP); Akira Suzuki, Tokyo (JP)

(72) Inventors: Hiromasa Takagi, Tokyo (JP); Masahiko Satoh, Tokyo (JP); Masaaki Yoshikawa, Tokyo (JP); Kenji Ishii, Kanagawa (JP); Hiroshi Yoshinaga, Chiba (JP); Tadashi Ogawa, Tokyo (JP); Takahiro Imada, Kanagawa (JP); Kazuya Saito, Kanagawa (JP); Naoki Iwaya, Tokyo (JP); Toshihiko Shimokawa, Kanagawa (JP); Kensuke Yamaji, Kanagawa (JP); Teppei Kawata, Kanagawa (JP); Takamasa Hase, Shizuoka (JP); Shuutaroh Yuasa, Kanagawa (JP); Takuya Seshita, Kanagawa (JP); Takeshi Uchitani, Kanagawa (JP); Arinobu Yoshiura, Kanagawa (JP); Hajime Gotoh, Kanagawa (JP); Akira Suzuki, Tokyo (JP)

(73) Assignee: RICOH COMPANY, LIMITED, Tokyo (JP)

( * ) Notice: Subject to any disclaimer, the term of this patent is extended or adjusted under 35 U.S.C. 154(b) by 56 days.

(21) Appl. No.: 13/727,817

(22) Filed: Dec. 27, 2012

(65) Prior Publication Data

US 2013/0164059 A1 Jun. 27, 2013

(30) Foreign Application Priority Data

Dec. 27, 2011 (JP) ..... 2011-285379
Dec. 6, 2012 (JP) ..... 2012-266957

(51) Int. Cl.
*G03G 15/20* (2006.01)

(52) U.S. Cl.
CPC ..... *G03G 15/2089* (2013.01); *G03G 15/206* (2013.01); *G03G 15/2053* (2013.01); *G03G 2215/2035* (2013.01)

(58) Field of Classification Search
CPC ..... G03G 15/2053; G03G 2215/2035
USPC ..... 399/329
See application file for complete search history.

(56) References Cited

U.S. PATENT DOCUMENTS 5,742,878 A 4/1998 Kuroda
7,885,590 B2 2/2011 Seo et al.

(Continued)

FOREIGN PATENT DOCUMENTS

CN 1137125 A 12/1996
CN 1532650 A 9/2004

(Continued)

OTHER PUBLICATIONS

U.S. Appl. No. 13/557,841, filed Jul. 25, 2012, Toshihiko Shimokawa, et al.

(Continued)

*Primary Examiner* — David Gray
*Assistant Examiner* — Tyler Hardman
(74) *Attorney, Agent, or Firm* — Harness, Dickey & Pierce PLC

(57) ABSTRACT

According to an embodiments, provided is a fixing device that includes: an endless fixing belt, heats and melts a toner image, and has flexibility; a stationary member that is set stationary on an inner peripheral surface side of the fixing belt and comes into contact under pressure to form a nip portion; and a reinforcement member that is set stationary on the inner peripheral surface side of the fixing belt and comes into abutment with the stationary member. If it is assumed that a length of the nip portion in a direction of conveyance of the recording medium is designated as A; and a length between an upstream-side abutment portion and a downstream-side abutment portion at which the stationary member and the reinforcement member come into abutment with each other is designated as B, following relation is established: A<B, and interval B includes interval A.

21 Claims, 4 Drawing Sheets

(56) References Cited

U.S. PATENT DOCUMENTS

| | | | | |
|---|---|---|---|---|
| 8,971,779 | B2 * | 3/2015 | Yoshinaga et al. | 399/329 |
| 2004/0218949 | A1 * | 11/2004 | Fukuzawa | G03G 15/2053 399/328 |
| 2006/0029411 | A1 | 2/2006 | Ishii et al. | |
| 2007/0212089 | A1 | 9/2007 | Seo et al. | |
| 2007/0280754 | A1 | 12/2007 | Ogawa et al. | |
| 2007/0292175 | A1 | 12/2007 | Shinshi | |
| 2008/0025772 | A1 | 1/2008 | Seo et al. | |
| 2008/0025773 | A1 | 1/2008 | Ito et al. | |
| 2008/0069611 | A1 * | 3/2008 | Obata et al. | 399/331 |
| 2008/0219721 | A1 | 9/2008 | Ito et al. | |
| 2008/0226326 | A1 | 9/2008 | Seo et al. | |
| 2008/0232873 | A1 | 9/2008 | Ueno et al. | |
| 2008/0247789 | A1 * | 10/2008 | Shin et al. | 399/329 |
| 2008/0298862 | A1 | 12/2008 | Shinshi | |
| 2009/0092423 | A1 | 4/2009 | Shin et al. | |
| 2009/0123201 | A1 | 5/2009 | Ehara et al. | |
| 2009/0148205 | A1 | 6/2009 | Seo et al. | |
| 2009/0245865 | A1 | 10/2009 | Shinshi et al. | |
| 2009/0245897 | A1 | 10/2009 | Seo et al. | |
| 2009/0297197 | A1 | 12/2009 | Hase | |
| 2010/0061753 | A1 | 3/2010 | Hase | |
| 2010/0074667 | A1 | 3/2010 | Ehara et al. | |
| 2010/0092220 | A1 | 4/2010 | Hasegawa et al. | |
| 2010/0092221 | A1 | 4/2010 | Shinshi et al. | |
| 2010/0202809 | A1 | 8/2010 | Shinshi et al. | |
| 2010/0290822 | A1 | 11/2010 | Hasegawa et al. | |
| 2010/0303521 | A1 | 12/2010 | Ogawa et al. | |
| 2011/0026988 | A1 * | 2/2011 | Yoshikawa et al. | 399/329 |
| 2011/0044706 | A1 | 2/2011 | Iwaya et al. | |
| 2011/0044734 | A1 | 2/2011 | Shimokawa et al. | |
| 2011/0052237 | A1 | 3/2011 | Yoshikawa et al. | |
| 2011/0052245 | A1 | 3/2011 | Shinshi et al. | |
| 2011/0052277 | A1 | 3/2011 | Ueno et al. | |
| 2011/0052282 | A1 | 3/2011 | Shinshi et al. | |
| 2011/0058862 | A1 | 3/2011 | Yamaguchi et al. | |
| 2011/0058863 | A1 | 3/2011 | Shinshi et al. | |
| 2011/0058864 | A1 | 3/2011 | Fujimoto et al. | |
| 2011/0058865 | A1 | 3/2011 | Tokuda et al. | |
| 2011/0058866 | A1 | 3/2011 | Ishii et al. | |
| 2011/0064437 | A1 | 3/2011 | Yamashina et al. | |
| 2011/0064443 | A1 | 3/2011 | Iwaya et al. | |
| 2011/0064450 | A1 | 3/2011 | Ishii et al. | |
| 2011/0064490 | A1 | 3/2011 | Imada et al. | |
| 2011/0064502 | A1 | 3/2011 | Hase et al. | |
| 2011/0076071 | A1 | 3/2011 | Yamaguchi et al. | |
| 2011/0085815 | A1 | 4/2011 | Kishi et al. | |
| 2011/0085832 | A1 | 4/2011 | Hasegawa et al. | |
| 2011/0091253 | A1 | 4/2011 | Seo et al. | |
| 2011/0091254 | A1 | 4/2011 | Shin et al. | |
| 2011/0116848 | A1 | 5/2011 | Yamaguchi et al. | |
| 2011/0129268 | A1 | 6/2011 | Ishii et al. | |
| 2011/0150518 | A1 | 6/2011 | Hase et al. | |
| 2011/0170917 | A1 | 7/2011 | Yoshikawa et al. | |
| 2011/0170920 | A1 * | 7/2011 | Fujiwara et al. | 399/331 |
| 2011/0176821 | A1 | 7/2011 | Hase | |
| 2011/0176822 | A1 | 7/2011 | Ishii et al. | |
| 2011/0182634 | A1 | 7/2011 | Ishigaya et al. | |
| 2011/0182638 | A1 | 7/2011 | Ishii et al. | |
| 2011/0194870 | A1 | 8/2011 | Hase et al. | |
| 2011/0200368 | A1 | 8/2011 | Yamaguchi et al. | |
| 2011/0200370 | A1 | 8/2011 | Ikebuchi et al. | |
| 2011/0206427 | A1 | 8/2011 | Iwaya et al. | |
| 2011/0211876 | A1 | 9/2011 | Iwaya et al. | |
| 2011/0217056 | A1 | 9/2011 | Yoshinaga et al. | |
| 2011/0217057 | A1 | 9/2011 | Yoshinaga et al. | |
| 2011/0217093 | A1 | 9/2011 | Tokuda et al. | |
| 2011/0217095 | A1 | 9/2011 | Ishii et al. | |
| 2011/0222875 | A1 | 9/2011 | Imada et al. | |
| 2011/0222876 | A1 | 9/2011 | Yuasa et al. | |
| 2011/0222888 | A1 | 9/2011 | Ikebuchi et al. | |
| 2011/0222929 | A1 | 9/2011 | Fujimoto et al. | |
| 2011/0222930 | A1 | 9/2011 | Fujimoto et al. | |
| 2011/0222931 | A1 | 9/2011 | Shinshi et al. | |
| 2011/0229162 | A1 | 9/2011 | Ogawa et al. | |
| 2011/0229178 | A1 | 9/2011 | Ogawa et al. | |
| 2011/0229181 | A1 | 9/2011 | Iwaya et al. | |
| 2011/0229200 | A1 | 9/2011 | Yamaguchi et al. | |
| 2011/0229225 | A1 | 9/2011 | Ishii et al. | |
| 2011/0229226 | A1 | 9/2011 | Tokuda et al. | |
| 2011/0229227 | A1 | 9/2011 | Yoshikawa et al. | |
| 2011/0229228 | A1 | 9/2011 | Yoshikawa et al. | |
| 2011/0229236 | A1 | 9/2011 | Ehara et al. | |
| 2011/0274453 | A1 | 11/2011 | Shimokawa et al. | |
| 2011/0286758 | A1 | 11/2011 | Yoshinaga | |
| 2011/0293309 | A1 | 12/2011 | Hase | |
| 2011/0311284 | A1 | 12/2011 | Seo et al. | |
| 2012/0008971 | A1 * | 1/2012 | Lee et al. | 399/69 |
| 2012/0045226 | A1 | 2/2012 | Hase et al. | |
| 2012/0051766 | A1 | 3/2012 | Ueno et al. | |
| 2012/0051774 | A1 | 3/2012 | Ikebuchi et al. | |
| 2012/0093531 | A1 | 4/2012 | Yuasa et al. | |
| 2012/0093551 | A1 | 4/2012 | Ogawa et al. | |
| 2012/0107005 | A1 | 5/2012 | Hase et al. | |
| 2012/0114345 | A1 | 5/2012 | Fujimoto et al. | |
| 2012/0114354 | A1 | 5/2012 | Saito et al. | |
| 2012/0121303 | A1 | 5/2012 | Takagi et al. | |
| 2012/0121304 | A1 | 5/2012 | Tokuda et al. | |
| 2012/0121305 | A1 | 5/2012 | Yoshikawa et al. | |
| 2012/0148303 | A1 | 6/2012 | Yamaguchi et al. | |
| 2012/0155935 | A1 | 6/2012 | Yoshikawa et al. | |
| 2012/0155936 | A1 | 6/2012 | Yamaguchi et al. | |
| 2012/0163889 | A1 * | 6/2012 | Koyama | 399/339 |
| 2012/0177388 | A1 | 7/2012 | Imada et al. | |
| 2012/0177393 | A1 | 7/2012 | Ikebuchi et al. | |
| 2012/0177420 | A1 | 7/2012 | Shimokawa et al. | |
| 2012/0177423 | A1 | 7/2012 | Imada et al. | |
| 2012/0177424 | A1 | 7/2012 | Saito et al. | |
| 2012/0207523 | A1 | 8/2012 | Ueno et al. | |
| 2012/0219312 | A1 | 8/2012 | Yuasa et al. | |
| 2012/0224878 | A1 | 9/2012 | Ikebuchi et al. | |
| 2012/0237273 | A1 | 9/2012 | Yoshinaga et al. | |
| 2012/0275832 | A1 * | 11/2012 | Suzuki | 399/329 |

FOREIGN PATENT DOCUMENTS

| | | | |
|---|---|---|---|
| CN | 1621964 | A | 6/2005 |
| CN | 102012662 | A | 4/2011 |
| JP | 3155066 | | 2/2001 |
| JP | 2006-301106 | A | 11/2006 |
| JP | 2007-293082 | A | 11/2007 |
| JP | 2007-334205 | | 12/2007 |
| JP | 2009-003410 | | 1/2009 |
| JP | 2009-093141 | | 4/2009 |
| JP | 2010-096782 | | 4/2010 |
| JP | 2011-076059 | | 4/2011 |
| JP | 2011-145455 | A | 7/2011 |
| JP | 2011-180220 | | 9/2011 |

OTHER PUBLICATIONS

Republic of China Office Action, dated Dec. 31, 2014, for Application No. 201210599347.3. (with English Translation).

* cited by examiner

FIXING DEVICE AND IMAGE FORMING DEVICE

CROSS-REFERENCE TO RELATED APPLICATIONS

The present application claims priority to and incorporates by reference the entire contents of Japanese Patent Application No. 2011-285379 filed in Japan on Dec. 27, 2011 and Japanese Patent Application No. 2012-266957 filed in Japan on Dec. 6, 2012.

BACKGROUND OF THE INVENTION

1. Field of the Invention

The present invention relates to an image forming device such as photocopiers, printers, facsimiles, or combined machines of the foregoing ones, and a fixing device mounted on the image forming device.

2. Description of the Related Art

There has been known fixing devices mounted on image forming devices, such as photocopiers and printers, that have a short warm-up time and a short first print time, and are less prone to cause a fixing error even if the devices are operated at a higher speed (for example, refer to Japanese Patent Application Laid-open No. 2010-96782).

Specifically, the fixing device shown in FIGS. 2, 4, and others of Japanese Patent Application Laid-open No. 2010-96782 is formed by a fixing belt (reference numeral 21); a pipe-like heating member fixedly provided so as to be opposed to an inner peripheral surface of the fixing belt except for a nip portion (reference numeral 22); a heater (reference numeral 25) provided inside the heating member for heating of the heating member; a stationary member (reference numeral 26) provided inside the fixing belt to contact under pressure a pressing roller (reference numeral 31) via the fixing belt to form the nip portion; an approximately plate-like reinforcement member (reference numeral 23) that contacts the stationary member for reinforcement of the stationary member, and the like. The approximately plate-like reinforcement member has a relatively narrow width (along a direction of conveyance) so as to abut a part of a surface of the stationary member.

In addition, when the fixing belt is heated by the pipe-like heating member heated by the heater, a toner image on a recording medium conveyed toward the nip portion, is fixed on the recording medium under heat and pressure at the nip portion.

Since the foregoing fixing device of Japanese Patent Application Laid-open No. 2010-96782 is mounted by fitting the stationary member into a concave portion of the pipe-like heating member, a contact area (contact width) of the reinforcement member with respect to the stationary member is small. However, even if the stationary member is subjected to a force from the reinforcement member in an unbalanced manner, the stationary member does not fall down due to the unbalanced force.

Meanwhile, the fixing device of Japanese Patent Application Laid-open No. 2010-96782 or the like may be configured, for the purposes of further improvement in heating efficiency of the fixing belt, reduction in cost and size of the fixing device and the like, such that the pipe-like heating member is eliminated and the fixing belt is heated directly by a heating unit with no intervention of the pipe-like heating member.

In this case, however, since there is no heating member (concave portion) for preventing falling of the stationary member, the stationary member in contact under pressure with the reinforcement member cannot be held in a well-balanced manner and thus may fall down. If the stationary member falls down, a desired nip cannot be formed, which leads to a fixing error on an output image or a conveyance error of a recording medium.

There are needs to solve the foregoing problem and to provide a fixing device that has a short warm-up time and a short first print time, does not cause a fixing error or the like even if the device is operated at a higher speed, and does not allow the stationary member in contact under pressure with the reinforcement member to fall down, and an image forming device.

SUMMARY OF THE INVENTION

It is an object of the present invention to at least partially solve the problems in the conventional technology.

According to an embodiments, provided is a fixing device that includes: an endless fixing belt that runs in a predetermined direction, heats and melts a toner image, and has flexibility; a stationary member that is set stationary on an inner peripheral surface side of the fixing belt and comes into contact under pressure with a pressing rotational body via the fixing belt to form a nip portion to which a recording medium is conveyed; and a reinforcement member that is set stationary on the inner peripheral surface side of the fixing belt and comes into abutment with the stationary member from inside of the fixing belt to reinforce the stationary member. If it is assumed that a length of the nip portion in a direction of conveyance of the recording medium is designated as A and a length between an upstream-side abutment portion at which the stationary member and the reinforcement member come into abutment with each other on the upstream side of the direction of conveyance and a downstream-side abutment portion at which the stationary member and the reinforcement member come into abutment with each other on the downstream-side of the direction of conveyance is designated as B, following relation is established: $A<B$, and a range of the nip portion in the direction of conveyance falls within a range between the upstream-side abutment portion and the downstream-side abutment portion.

According to another embodiment, provided is an image forming device that includes the fixing device mentioned above.

In the subject application, a state where the stationary member or the reinforcement member is "set stationary" is defined as a state where the stationary member or the reinforcement member is not driven or rotated but is held without rotation. Therefore, even if the stationary member is biased toward the nip portion by a bias member such as a spring, for example, the stationary member is held without rotation and thus the stationary member is "set stationary."

In the subject application, the "direction of conveyance" of the recording medium is defined as identical to the tangential direction of the nip portion in contact with the fixing belt and a pressing rotational body in an ideal arc without being deformed.

In the subject application, the "width direction" refers to a direction orthogonal to the direction of conveyance, and is defined as identical to a direction of rotational axis of the fixing belt and the pressing rotational body.

In the subject application, the "nip portion" is defined as a portion of the pressing rotational body in contact with the fixing belt.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
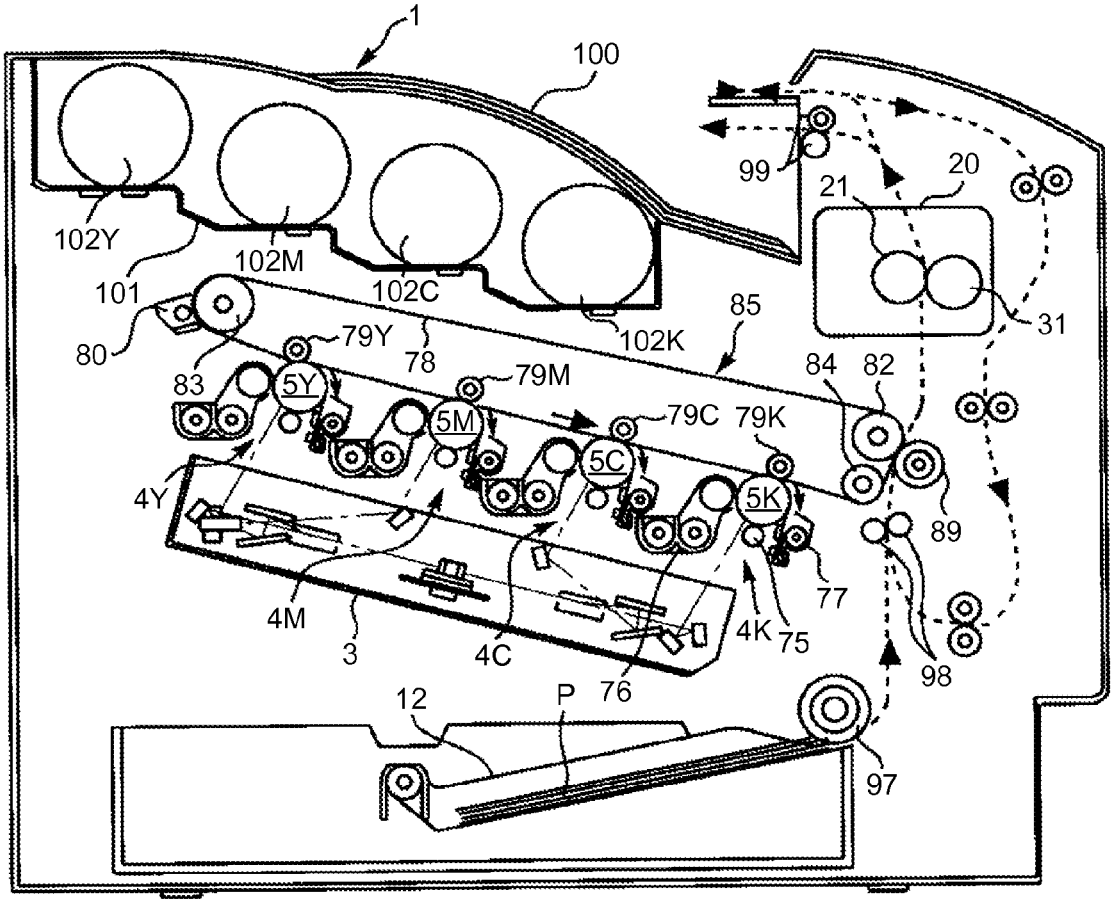
FIG. 1 is a diagram illustrating an overall configuration of an image forming device in a first embodiment.

Embodiments will be described below in detail with reference to the drawings. In each of the drawings, identical or equivalent components are given identical reference numerals, and duplicated descriptions thereof are simplified or omitted as appropriate.

First Embodiment

Referring to FIGS. 1 to 6, a first embodiment will be described in detail.

First, referring to FIG. 1, an overall configuration and operation of an image forming device will be described.

As illustrated in FIG. 1, an image forming device in the first embodiment is a tandem color printer. The image forming device main body 1 includes at the upper part thereof a bottle storage portion 101 having four toner bottles 102Y, 102M, 102C, and 102K corresponding to colors (yellow, magenta, cyan, and black) set in a removable (changeable) manner.

An intermediate transfer unit 85 is provided under the bottle storage portion 101. Aligned so as to be opposed to an intermediate transfer belt 78 of the intermediate transfer unit 85 are image forming units 4Y, 4M, 4C, and 4K corresponding to the colors (yellow, magenta, cyan, and black).

Photosensitive drums 5Y, 5M, 5C, and 5K are provided at the image forming units 4Y, 4M, 4C, and 4K, respectively. Provided around the photosensitive drums 5Y, 5M, 5C, and 5K are charging units 75, developing units 76, cleaning units 77, neutralization units (not illustrated), and the like. On the photosensitive drums 5Y, 5M, 5C, and 5K, an image forming process (charging step, exposing step, developing step, transfer step, and cleaning step) is performed to form images in the colors on the photosensitive drums 5Y, 5M, 5C, and 5K.

The photosensitive drums 5Y, 5M, 5C, and 5K are driven and rotated by a driving motor not illustrated, in a clockwise direction illustrated in FIG. 1. Then, surfaces of the photosensitive drums 5Y, 5M, 5C, and 5K are evenly electric-charged at the charging units 75 (the charging step).

After that, the surfaces of the photosensitive drums 5Y, 5M, 5C, and 5K reach positions of irradiation by laser light L emitted from an exposing unit 3, and exposure scanning is performed at the positions to form electrostatic latent images corresponding to the colors on the surfaces (the exposing step).

After that, the surfaces of the photosensitive drums 5Y, 5M, 5C, and 5K reach positions opposed to the developing units 76, and the electrostatic latent images are developed at the positions to form toner images in the colors (the developing step).

After that, the surfaces of the photosensitive drums 5Y, 5M, 5C, and 5K reach positions opposed to the intermediate transfer belt 78 and primary transfer bias rollers 79Y, 79M, 79C, and 79K, and the toner images on the photosensitive drums 5Y, 5M, 5C, and 5K are transferred to the intermediate transfer belt 78 at the positions (a primary transfer step). At that time, slight amounts of toner are not transferred but remains on the photosensitive drums 5Y, 5M, 5C, and 5K.

After that, the surfaces of the photosensitive drums 5Y, 5M, 5C, and 5K reach positions opposed to the cleaning units 77, and the non-transferred toner on the photosensitive drums 5Y, 5M, 5C, and 5K is mechanically collected at the positions by cleaning blades of the cleaning units 77 (a cleaning step).

Finally, the surfaces of the photosensitive drums 5Y, 5M, 5C, and 5K reach positions opposed to neutralization units not illustrated, and residual potentials are removed from the photosensitive drums 5Y, 5M, 5C, and 5K at the positions.

Accordingly, a series of steps of the image forming process on the photosensitive drums 5Y, 5M, 5C, and 5K is completed.

After that, the toner images of the colors formed on the photosensitive drums through the developing step are transferred in an overlapping manner onto the intermediate transfer belt 78. Accordingly, a color image is formed on the intermediate transfer belt 78.

In this arrangement, the intermediate transfer unit 85 includes the intermediate transfer belt 78, the four primary transfer bias rollers 79Y, 79M, 79C, and 79K, a secondary transfer backup roller 82, a cleaning backup roller 83, a tension roller 84, an intermediate transfer cleaning unit 80, and the like. The intermediate transfer belt 78 is stretched and supported by the three rollers 82 to 84, and is endless-moved in a direction of arrow in FIG. 1 by rotary driving of the one roller 82.

The four primary transfer bias rollers 79Y, 79M, 79C, and 79K form primary transfer nips by sandwiching the intermediate transfer belt 78 between the primary transfer bias rollers 79Y, 79M, 79C, and 79K and the photosensitive drums 5Y, 5M, 5C, and 5K. In addition, a reverse transfer bias of the polarity of the toner is applied to the primary transfer bias rollers 79Y, 79M, 79C, and 79K.

Then, the intermediate transfer belt 78 runs in the direction of arrow and passes through in sequence the primary transfer nips of the primary transfer bias rollers 79Y, 79M, 79C, and 79K. Accordingly, the toner image of the colors on the photosensitive drums 5Y, 5M, 5C, and 5K are transferred in an overlapping manner onto the intermediate transfer belt 78.

After that, the intermediate transfer belt 78 on which the toner images of the colors are transferred in an overlapping manner, reaches a position opposed to a secondary transfer roller 89. At this position, the secondary transfer backup roller 82 forms a secondary transfer nip by sandwiching the intermediate transfer belt 78 between the secondary transfer backup roller 82 and the secondary transfer roller 89. Then, the toner images of the four colors formed on the intermediate transfer belt 78 are transferred onto a recording medium P conveyed to the position of the secondary transfer nip. At that time, there remains some toner not transferred to the recording medium P on the intermediate transfer belt 78.

After that, the intermediate transfer belt 78 reaches a position of the intermediate transfer cleaning unit 80. Then, the non-transferred toner on the intermediate transfer belt 78 is collected at this position.

Accordingly, a series of steps of the transfer process on the intermediate transfer belt 78 is completed.

In this arrangement, the recording medium P is conveyed to the position of the secondary transfer nip from a paper feeding unit 12 which is provided under the device main body 1 through a paper feeding roller 97, a pair of registration rollers (pair of timing rollers) 98, and the like.

Specifically, the paper feeding unit 12 stores a plurality of sheets of the recording medium P such as transfer paper in a stacked manner. When the paper feeding roller 97 is driven and rotated in a counterclockwise direction in FIG. 1, the recording medium P on the top is fed toward between the pair of registration rollers 98.

The recording medium P conveyed to the pair of registration rollers 98 temporarily stops at a roller nip of the pair of registration rollers 98 in a halted state. Then, the pair of registration rollers 98 are rotated and driven again in a manner timed with the color image on the intermediate transfer belt 78, and the recording medium P is conveyed to the secondary transfer nip. Accordingly, a desired color image is transferred onto the recording medium P.

After that, the recording medium P onto which the color image is transferred at the secondary transfer nip is conveyed to the position of the fixing device 20. Then, at this position, the color image transferred onto the surface of the recording medium P is fixed onto the recording medium P by heat and pressure from the fixing belt 21 and the pressing roller 31.

After that, the recording medium P is ejected from the device through a pair of ejecting rollers 99. The recording medium P ejected from the device by the pair of ejecting rollers 99 is stacked in sequence as output images on a stack portion 100.

Accordingly, a series of steps of the image forming process at the image forming device is completed.

Next, a configuration and operation of a fixing device 20 mounted in the image forming device main body 1 will be described below in detail referring to FIGS. 2 to 6.

Figure 2:
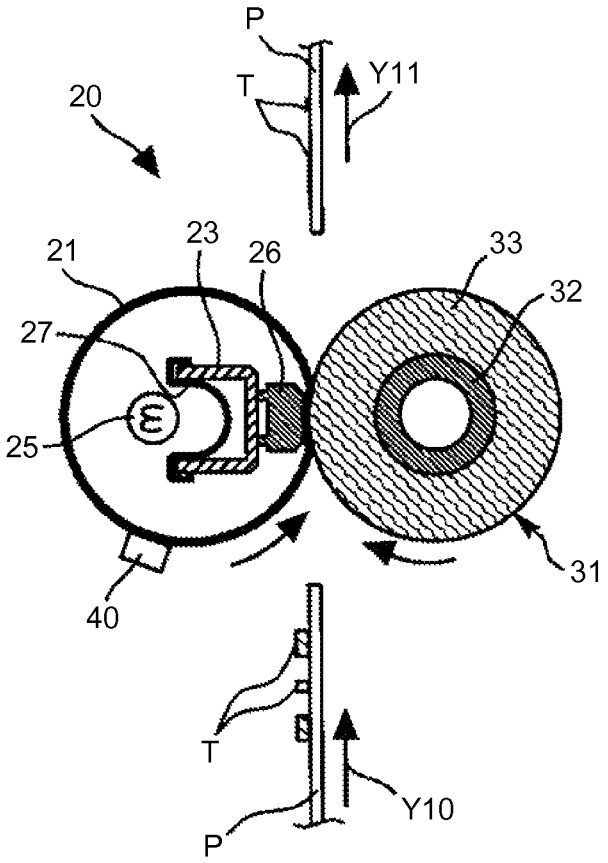
FIG. 2 is a diagram illustrating a configuration of a fixing device.
Figure 3:
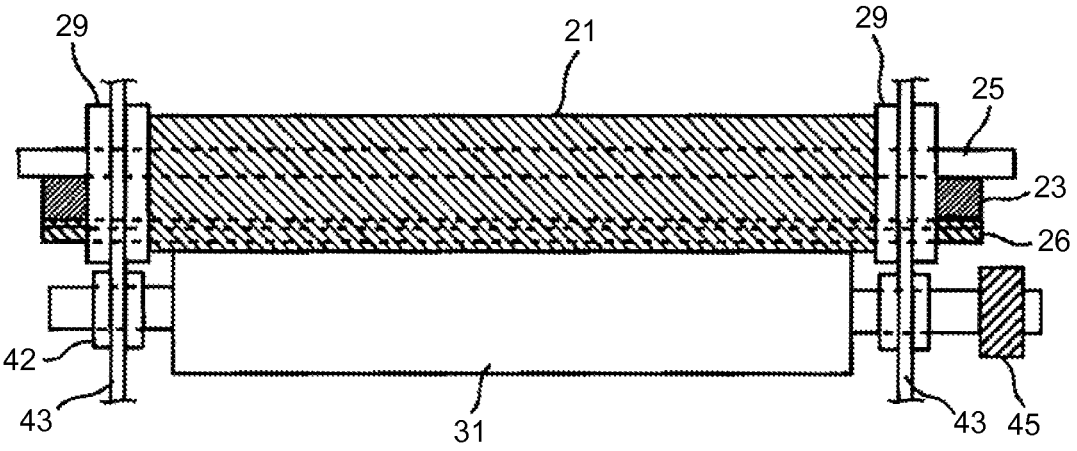
FIG. 3 is a side view of the fixing device as seen in a width direction.
Figure 4:
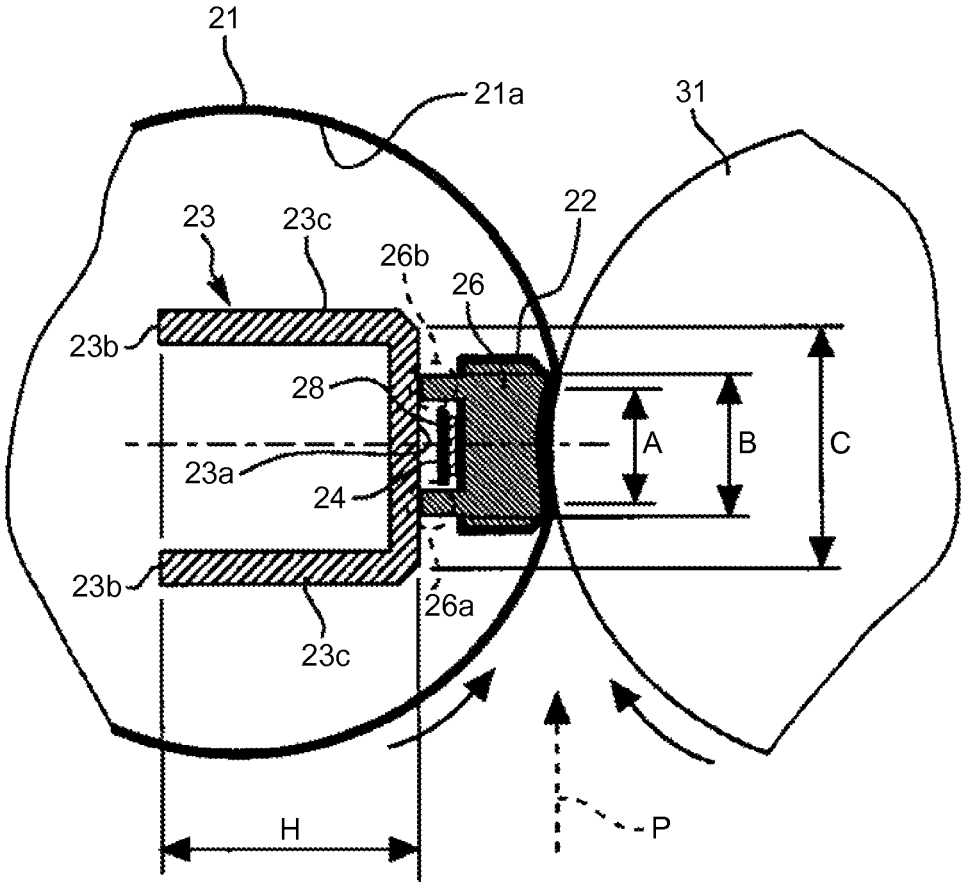
FIG. 4 is an enlarged view of a nip portion and a neighboring portion thereof.

Referring to FIGS. 2 to 4 and others, the fixing device 20 includes a fixing belt 21 (belt member) as a fixing member, a stationary member 26 (nip portion forming member), a reinforcement member 23, a heater 25 (heat source) as a heating unit, a pressing roller 31 as a pressing rotational body, a temperature sensor 40, a reflection member 27, a sheet-like member 22, a screw 24, a plate-like member 28 (stationary plate), and the like.

The fixing belt 21 is a thin-walled, flexible endless belt that rotates (runs) in a direction of arrow (counterclockwise) in FIG. 2. The fixing belt 21 has a base material layer, an elastic layer, and a release layer laminated in sequence from an inner peripheral surface 21*a* (a surface of sliding contact with the stationary member 26) side. The fixing belt 21 has entirely a thickness of 1 mm or less.

The base material layer of the fixing belt 21 has a thickness of 30 to 50 μm and is made of a metal material such as nickel or stainless steel, or a resin material such as polyimide.

The elastic layer of the fixing belt 21 has a thickness of 100 to 300 μm and is made of a rubber material such as silicon rubber, foaming silicon rubber, or fluorine rubber. When the elastic layer is provided, no micro asperities are formed on the surface of the fixing belt 21 at the nip portion. This makes it possible to transfer evenly heat to a toner image T on the recording medium P and suppress occurrence of an orange-peel image.

The release layer of the fixing belt 21 has a thickness of 10 to 50 μm and is made of a material such as PFA (tetrafluoroethylene perfluoroalkyl vinyl ether copolymer), PTFE (polytetrafluoroethylene), polyimide, polyetherimide, PES (polyether sulfide). When the release layer is provided, a release property (peel property) is secured with respect to the toner T (toner image).

The fixing belt 21 has a diameter of 15 to 120 mm. In the first embodiment, the fixing belt 21 has an internal diameter of 30 mm.

The stationary member 26, the heater (heating unit), the reinforcement member 23, the reflection member 27, the sheet-like member 22, the screw 24, the plate-like member 28 (stationary plate), and the like are set in a stationary state on the inside of the fixing belt 21 (inner peripheral surface side).

Figure 5:
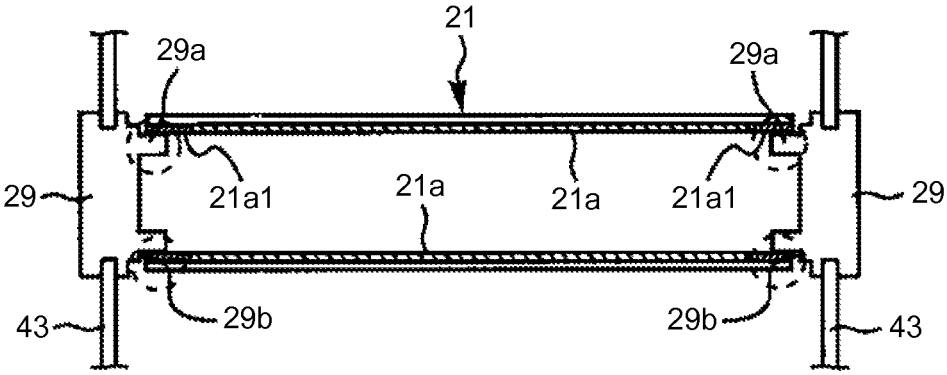
FIG. 5 is a cross section view of a fixing belt held by a holding member.

In this arrangement, the stationary member 26 is set stationary so as to be in sliding contact with the inner peripheral surface 21*a* of the fixing belt 21. Then, when the stationary member 26 contacts under pressure the pressing roller 31 via the fixing belt 21, thereby to form the nip portion to which the recording medium P is conveyed. Referring to FIGS. 3 and 5, the stationary member 26 is held at both end portions in the width direction by flanges 29 (holding member) fixedly supported by side plates 43 of the fixing device 20. The fixing belt 21 is rotatably held at both end portions in the width direction by flanges 29. Configurations of the stationary member 26 and the flanges 29 will be described later in detail.

Then, the fixing belt 21 is heated directly by radiation heat from the heater 25 (heating unit) mounted inside the fixing belt 21.

The heater 25 as a heating unit is a halogen heater (or carbon heater) which is fixed at both end portions to the side plates 43 of the fixing device 20 (see FIG. 3). Then, the fixing belt 21 is heated mainly except for the nip portion by radiation heat from the heater 25 (heating unit) under output control by a power source unit of the device main body 1. Further, heat from the surface of the heated fixing belt 21 is applied to the toner image T on the recording medium P. Output control of the heater 25 is performed based on results of detection of a belt surface temperature by the temperature sensor 40 such as a thermistor opposed to the surface of the fixing belt 21. This output control of the heater 25 makes it possible to set a temperature of the fixing belt 21 (fixing temperature) at a desired value.

In the first embodiment, the one heater 25 is provided on the inner peripheral surface side of the fixing belt 21. Alternatively, a plurality of heaters may be provided on the inner peripheral surface side of the fixing belt 21.

As in the foregoing, the fixing device 20 in the first embodiment is heated not locally at only a portion of the fixing belt 21 but at a relatively wide area of the fixing belt 21 in the peripheral direction. Accordingly, it is possible to sufficiently heat the fixing belt 21 and suppress occurrence of a fixing error even if the device is operated at a higher speed. Specifically, it is possible to efficiently heat the fixing belt 21 in a relatively simple configuration, thereby to shorten a warm-up time and a first print time and achieve reduction in device in size.

In particular, in the fixing device 20 of the first embodiment, the fixing belt 21 is configured to be heated directly by the heater 25 (heating unit), which makes it possible to further improve efficiency of heating the fixing belt 21 and further reduce the fixing device 20 in cost and size.

Figure 6:
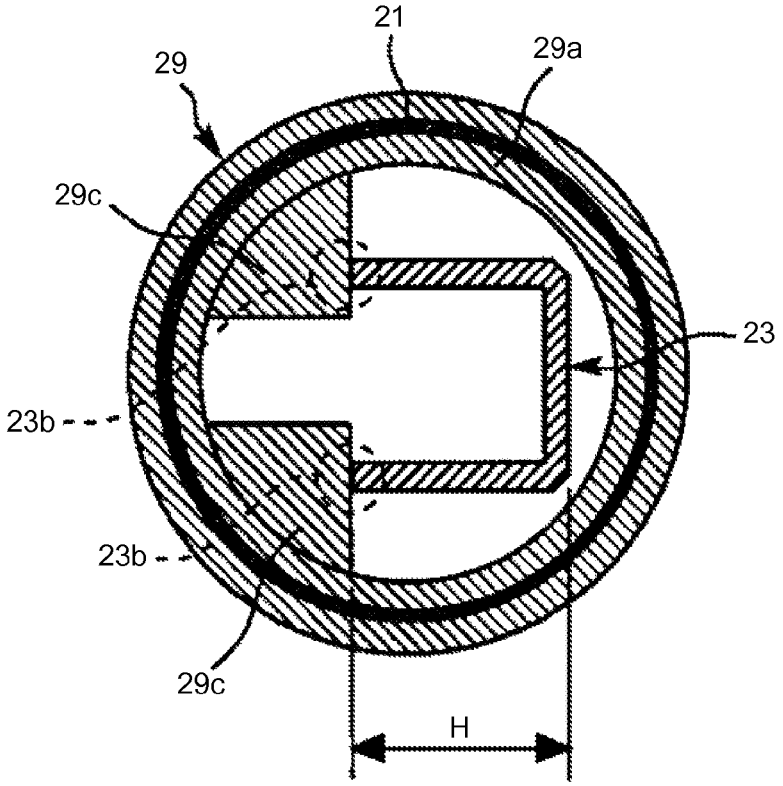
FIG. 6 is a schematic front view of the fixing belt and a reinforcement member held by the holding member.

Referring to FIGS. 5 and 6, the two flanges as holding members are made of a heat-resistant resin material or the like, and are fitted into the side plates 43 of the fixing device 20 at both end portions in the width direction. The flanges 29 are provided with guide portions 29*a* for holding the fixing belt 21 while maintaining the fixing belt 21 in a circular form, and stopper portions 29*b* for restricting movements (belt bias) of the fixing belt 21 in the width direction, and the like.

In addition, formed on the inner peripheral surface 21*a* of the fixing belt 21 are low-friction portions 21*a*1 for decreasing sliding resistance at the sliding portions (enclosed with broken lines in FIG. 5) with respect to the guide portions 29*a* of the flanges 29 on both end parts thereof in the width direction (a right-left direction in FIG. 5). Specifically, the low-friction portions 21*a*1 are formed by coating the surface of a base material layer with a low-friction material such as fluorine resin or the like. Such a configuration makes the fixing belt 21 and the flanges 29 (guide portions 29*a*) less prone to be worn or deteriorated even if the fixing belt 21 and the flanges 29 (guide portions 29*a*) are in sliding contact with each other by rotation (running) of the fixing belt 21.

In the first embodiment, the inner peripheral surface 21*a* of the fixing belt 21 is in contact only with the flanges 29 on both ends in the width direction and the stationary member 26. No other member (such as a belt guide) is in contact with the inner peripheral surface 21*a* to guide the rotation of the fixing belt 21.

In the first embodiment, the reinforcement member 23 is set stationary on the inner peripheral surface side of the fixing belt 21 to reinforce strength of the stationary member 26 forming the nip portion. Referring to FIG. 3, the reinforcement member 23 is formed so as to be identical in length in the width direction to the stationary member 26. The reinforcement member 23 has both end portions in the width direction held by the flanges 29 (holding members) of the fixing device 20. Specifically, the reinforcement member 23 is sandwiched and determined in position between the flanges 29 and the stationary member 26.

In addition, the reinforcement member 23 abuts the pressing roller 31 via the stationary member 26 and the fixing belt 21, which prevents that the stationary member 26 are largely deformed at the nip portion under pressure from the pressing roller 31. In the first embodiment, the reinforcement member 23 is an approximately horizontal U-shaped, plate-like member having a concave portion opposed to the heater 25. The reinforcement member 23 is preferably made of a metal material with high mechanical strength such as stainless steel or iron, for satisfying the above-mentioned function.

A configuration of the reinforcement member 23 will be described later in more detail.

In the first embodiment, the reflection member 27 (reflector) is set stationary on the reinforcement member 23 on a side opposed to the heater 25. Accordingly, heat (for heating the reinforcement member 23) transferred from the heater 25 to the reinforcement member 23, is reflected by the reflection member 27 for use in heating the fixing belt 21. This further improves efficiency of heating the fixing belt 21.

The same advantage can be obtained even if some or all of the surfaces of the reinforcement member 23 opposed to the heater 25 is provided with a mirror finish or a heat insulating material.

Referring to FIG. 2, the pressing roller 31 as a pressing rotational body abutting the outer peripheral surface of the fixing belt 21 at the position of the nip portion, is 30 mm in diameter and has an elastic layer 33 on a core metal 32 of a hollow structure. The elastic layer 33 of the pressing roller 31 (pressing rotational body) is made of a material such as foaming silicon rubber, silicon rubber, or fluorine rubber. The elastic layer 33 may have on a surface layer thereof a thin-walled release layer made of PFA, PTFE, or the like. The pressing roller 31 contacts under pressure the fixing belt 21 to form a desired nip portion between the two members. Referring to FIG. 3, the pressing roller 31 is provided with a gear 45 engaging a drive gear in a driving mechanism not illustrated, and the pressing roller 31 is driven and rotated by the drive gear in the direction of arrow (clockwise) in FIG. 2. In addition, the pressing roller 31 is rotatably supported at both end portions in the width direction by the side plates 43 of the fixing device 20 via shaft bearings 42. The pressing roller 31 may have a heat source such as a halogen heater therewithin.

If the elastic layer 33 of the pressing roller 31 is made of a sponge-like material such as foaming silicon rubber, it is possible to decrease a pressing force applied to the nip portion, thereby to reduce a load on a stationary member 16. Further, the pressing roller 31 is enhanced in heat insulation to make heat from the fixing belt 21 less prone to move to the pressing roller 31, thereby improving efficiency of heating the fixing belt 21.

In the first embodiment, the fixing belt 21 is almost the same in diameter as the pressing roller 31. Alternatively, the fixing belt 21 may be formed so as to be smaller in diameter than the pressing roller 31. In this case, the fixing belt 21 has a smaller curvature than that of the pressing roller 31 at the nip portion, whereby the recording medium P sent out from the nip portion is prone to be separated from the fixing belt 21.

Referring to FIG. 4, the stationary member 26 in sliding contact with the inner peripheral surface 21*a* of the fixing belt 21 has a surface opposed to the pressing roller 31 (sliding contact surface) formed in a concave shape so as to follow the curvature of the pressing roller 31. Accordingly, the recording medium P is sent out from the nip portion so as to follow the curvature of the pressing roller 31. This makes it possible to prevent a problem that the recording medium P after the fixing step sticks to the fixing belt 21 and is not separated from the same.

In the first embodiment, the stationary member 26 forming the nip portion is formed in a concave shape. Alternatively, the stationary member 26 forming the nip portion may be formed in a planar shape. That is, the stationary member 26 may have the sliding contact surface (opposed to the pressing roller 31) formed in a planar shape. Accordingly, the nip portion becomes approximately parallel to an image surface on the recording medium P to enhance adhesion between the fixing belt 21 and the recording medium P, resulting in improvement of fixing property. Further, the curvature of the fixing belt 21 becomes large at an exit side of the nip portion, which makes it possible to easily separate the recording medium P sent from the nip portion, from the fixing belt 21.

In addition, the stationary member 26 is made of a heat-resistant and heat-insulating resin material such as a material with specific rigidity (for example, liquid crystal polymer), a high-hardness elastic material, or the like, so as not to be largely warped under a pressing force from the pressing roller 31.

The stationary member 26 is covered with the sheet-like member 22 made of a low-friction material such as PTFE to reduce a sliding resistance with respect to the fixing belt 21. Specifically, the sheet-like member 22 covers the circumference of the stationary member 26 (the circumference of the stationary member 26 as seen in the cross section view of FIG. 4) so as to intervene between the stationary member 26 and the fixing belt 21 in the width direction at the position of the nip portion. In addition, the sheet-like member 22 in the first embodiment is made of a fiber material (a cloth member made of PTFE) impregnated with a lubricant agent such as silicon oil. Accordingly, the lubricating agent is held by an abutment surface between the stationary member 26 and the fixing belt 21. Therefore, it is possible to decrease occurrence of a trouble that the stationary member 26 and the fixing belt 21 are worn due to sliding contact between the two members 21 and 26.

Referring to FIG. 4, the sheet-like member 22 has a plurality of hole portions that fits to an upstream-side projection portion 26*a* and a downstream-side projection portion 26*b*. In addition, the sheet-like member 22 is closely attached to the stationary member 26 in the peripheral direction in position except for the two projection portions 26*a* and 26*b*.

Specifically, the sheet-like member 22 has a rectangular shape when being developed as a single component. The rectangular sheet-like member 22 has on both ends thereof the plurality of hole portions (which is fitted to the projection portions 26*a* and 26*b*) and screw hole portions (into which screw portions of the screws 24 are inserted).

When covering the stationary member 26, the sheet-like member 22 has both rectangular ends folded and doubled between the upstream-side projection portion 26*a* and the downstream-side projection portion 26*b* to form an overlapping portion. The plate-like member 28 is fixed by a plurality of screws 24 (provided in the width direction) to the stationary member 26 so as to sandwich the overlapping portion of the sheet-like member 22 between the stationary member 26 and the plate-like member 28. Specifically, the plate-like member 28 is placed on the stationary member 26 via the overlapping portion so as to sandwich the overlapping portion of the sheet-like member 22 between the plate-like member 28 and the stationary member 26, and the screw portions of the screws 24 are inserted through the screw hole portions of the plate-like member 28 and the screw hole portions of the sheet-like member 22, and screwed to female screw portions of the stationary member 26. The screws 24 are formed such that the screw heads thereof do not contact the reinforcement member 23 beyond the projection portions 26*a* and 26*b*.

In the first embodiment, the reinforcement member 23 (with the reflection member 27) is provided to isolate a space between the stationary member 26 and the heater 25 (heating unit).

In the first embodiment, the heater 25 is opposed to a relatively wide area (inner peripheral surface 21*a*) of the fixing belt 21 in the peripheral direction, which makes it possible to heat the fixing belt 21 without temperature variation in the peripheral direction even on heating standby (waiting for a printing operation). Therefore, immediately upon reception of a print request, a printing operation can be performed. On a conventional on-demand fixing device (for example, see Japanese Patent No. 2884714 official gazette), if heat is applied to the deformed pressing roller at the nip portion on heating standby, the pressing roller may be thermally-deteriorated and shortened in lifetime, or may suffer compressive permanent strain (compressive permanent strain of rubber increases with heat applied to the deformed rubber), depending on rubber material of the pressing roller. If the pressing roller has compressive permanent strain, the pressing roller is partly recessed, which makes it impossible to obtain a desired nip width, thereby causing a fixing error or an abnormal noise during rotation of the pressing roller.

In contrast to this, in the first embodiment, the reinforcement member 23 (and the reflection member 27) is provided between the stationary member 26 and the heater 25 to block out heat from the heater 25, which makes the heat less prone to reach the stationary member 26 on heating standby. Therefore, it is possible to decrease occurrence of a trouble that the pressing roller 31 deformed on heating standby is further heated at a high temperature, thereby to suppress occurrence of the foregoing problem.

Further, the lubricating agent applied between the stationary member 26 and the fixing belt 21 for reducing a frictional resistance between the two members, may be deteriorated due to use at the nip portion under high-pressure conditions and high-temperature conditions, which results in a trouble such as slippage of the fixing belt 21.

In contrast to this, in the first embodiment, the reinforcement member 23 (with the reflection member 27) is provided between the stationary member 26 and the heater 25 so as to block out heat from the heater 25, which makes heat from the heater 25 less prone to reach the lubricating agent at the nip portion. Therefore, it is possible to reduce deterioration of the lubricating agent at high temperatures and prevent occurrence of the foregoing problem.

In the first embodiment, the reinforcement member 23 (with the reflection member 27) is provided between the stationary member 26 and the heater 25 so as to block out heat from the heater 25. Accordingly, the stationary member 26 is heat-insulated and thus the fixing belt 21 is not positively heated at the nip portion. Therefore, the recording medium P sent into the nip portion is then sent out of the nip portion under a lower temperature. Specifically, at the exit of the nip portion, a toner image fixed onto the recording medium P is under a lower temperature and the toner is lowered in viscosity, and thus the recording medium P is separated from the fixing belt 21 with a smaller toner adhesion force on the fixing belt 21. Therefore, it is possible to prevent a trouble that the recording medium P, immediately after the fixing step, is wound and jammed on the fixing belt 21, and suppress adhesion of toner to the fixing belt 21.

A normal operation of the thus configured fixing device 20 will be briefly described below. When the device main body 1 is switched on, the heater 25 is powered and the pressing roller 31 is driven and rotated in the direction of arrow in FIG. 2. Accordingly, the fixing belt 21 is also driven (rotated) in the direction of arrow in FIG. 2 by a force of friction between the fixing belt 21 and the pressing roller 31 at the nip portion.

After that, the recording medium P is fed from the paper feeding unit 12, and a color image is supported (transferred) on the recording medium P in an unfixed manner at the position of the secondary transfer roller 89. The recording medium P with the unfixed image T (toner image) supported thereon is guided by a guide plate not illustrated and is conveyed in a direction of an arrow Y10 in FIG. 2. The recording medium P is then sent to the nip portion between the fixing belt 21 and the pressing roller 31 in contact under pressure with each other.

Then, the toner image T is fixed onto the surface of the recording medium P by heat from the fixing belt 21 heated by the heater 25 and a pressing force of the stationary member 26 reinforced by the reinforcement member 23 and the pressing roller 31. After that, the recording medium P sent out from the nip portion is conveyed in a direction of an arrow Y11.

Configuration and operation of the fixing device 20 in the first embodiment will be described below in detail.

As described above, the fixing device 20 in the first embodiment is provided with the stationary member 26 that is set stationary on the inner peripheral surface side of the fixing belt 21 and contacts under pressure the pressing roller 31 via the fixing belt 21 to form the nip portion; and the reinforcement member 23 that is set stationary on the inner peripheral surface side of the fixing belt 21 and abuts the stationary member 26 from the inside of the fixing belt 21 to reinforce the stationary member 26.

In the first embodiment, as shown in FIG. 4, if it is assumed that a length of the nip portion (nip width) in a direction of conveyance of the recording medium is designated as A and a length between an upstream-side abutment portion at which the stationary member 26 and the reinforcement member 23 come into abutment with each other on the upstream side of the direction of conveyance and a downstream-side abutment portion at which the stationary member 26 and the reinforcement member 23 come into abutment with each other on the downstream-side of the direction of conveyance, is designated as B, the following relation is established:

$$A<B$$

Further, a range of the nip portion (illustrated with A in FIG. 4) in the direction of conveyance falls within a range between the upstream-side abutment portion and the downstream-side abutment portion (illustrated with B in FIG. 4).

In other words, the nip width is included in the range of the stationary member 26 abutting the reinforcement member 23 in the direction of conveyance (the up-down direction in FIG. 4).

According to the configuration described above, it is possible to hold the stationary member 26 in contact under pressure with the reinforcement member 23 in a well-balanced manner even if there is no pipe-like heating member into which the stationary member 26 is fitted and set stationary, thereby to suppress occurrence of a trouble that the stationary member 26 falls down. In addition, the desired nip portion can be formed with high accuracy to prevent occurrence of troubles such as a fixing error in an output image or a conveyance error of the recording medium.

That is, if the foregoing conditions are not satisfied, the stationary member 26 subjected to an under-pressure contact force at the nip portion is prone to rotate (fall down) clockwise or counterclockwise in FIG. 4, with the abutment portion with respect to the reinforcement member 23 as a fulcrum. In contrast to this, if the foregoing conditions are satisfied, the stationary member 26 subjected to an under-pressure contact force at the nip portion is supported by the reinforcement member 23 in a well-balanced manner. Accordingly, the stationary member 26 is less prone to fall down with the abutment portion with respect to the reinforcement member 23 as a fulcrum.

Further, in the first embodiment, as shown in FIG. 4, if it is assumed that a length of an opposed surface 23*a* of the reinforcement member 23 opposed to the stationary member 26 in the direction of conveyance is designated as C, the following relations are established:

$$A<B<C$$

In addition, the range between the upstream-side abutment portion and the downstream-side abutment portion in the direction of conveyance (illustrated with B in FIG. 4) falls within a range of the opposed surface 23*a* of the reinforcement member 23 (illustrated with C in FIG. 4).

In other words, the range of the stationary member 26 abutting the reinforcement member 23 in the direction of conveyance is included in the range of the opposed surface 23*a* of the reinforcement member 23 in the direction of conveyance.

According to the foregoing configuration, the stationary member 26 subjected to an under-pressure contact force at the nip portion is prone to be supported by the reinforcement member 23 in a more well-balanced manner, which makes the stationary member 26 further less prone to fall down.

In the first embodiment, referring to FIG. 4, the stationary member 26 and the reinforcement member 23 are in line symmetric with respect to a virtual straight line passing through the center of the direction of conveyance at the nip portion and orthogonal to the direction of conveyance (as illustrated by a dashed line in FIG. 4) as seen in a cross section orthogonal to the width direction.

According to the configuration described above, the stationary member 26 subjected to an under-pressure contact force at the nip portion is prone to be supported by the reinforcement member 23 in a more well-balanced manner, which makes the stationary member 26 further less prone to fall down.

In particular, the reinforcement member 23 in the first embodiment has erection portions 23*c* erected with the same length H in a direction separated from the opposed surface 23*a*, on the upstream and downstream sides of the direction of conveyance, respectively. In addition, the two erection portions 23*c* have end surfaces (reference surfaces 23*b*) that abut the holding portions 29*c* of the flanges 29 (refer to FIG. 6) to hold the reinforcement member 23.

According to the foregoing configuration, the stationary member 26 subjected to an under-pressure contact force at the nip portion is prone to be supported by the reinforcement member 23 in a more well-balanced manner, which makes the stationary member 26 further less prone to fall down.

Alternatively, the reinforcement member 23 may be held by abutment with the side plates 43, instead of the holding portions 29*c* of the flanges 29.

Referring to FIG. 4, the stationary member 26 in the first embodiment is provided with the upstream-side projection portion 26*a* that projects toward the opposed surface 23*a* of the reinforcement member 23 to form the upstream-side abutment portion with respect to the reinforcement member 23; and the downstream-side projection portion 26*b* that projects toward the opposed surface 23*a* of the reinforcement member 23 to form the downstream-side abutment portion with respect to the reinforcement member 23. That is, the stationary member 26 is provided with the two projection portions 26*a* and 26*b* separated in the direction of conveyance on the side opposed to the reinforcement member 23 (a distance between the upstream-side end portion and the downstream-side end portion is set as B). The two projection portions 26*a* and 26*b* each come into contact by surface with the opposed surface 23*a* of the reinforcement member 23.

According to the configuration as described above, it is possible to reduce a contact area between the reinforcement member 23 and the stationary member 26 as compared to the case where the stationary member 26 is formed so as to have one flat surface from the upstream-side abutment portion to the downstream-side abutment portion with respect to the reinforcement member 23. Accordingly, heat from the fixing belt 21 is less prone to transfer to the stationary member 26. That is, it is possible to reduce heat transferred from the fixing belt 21 at the nip portion through the stationary member 26 to the reinforcement member 23 (it is possible to reduce amount of heat escaping from the fixing belt 21 through the stationary member 26 to the reinforcement member 23). In particular, if the fixing belt 21 is made thinner (for example, a thickness of 160 μm or less) or the nip width is made larger, heat from the fixing belt 21 is prone to transfer to the stationary member 26. In this case, it is useful to decrease the contact area between the reinforcement member 23 and the stationary member 26 as in the first embodiment.

In the first embodiment, the two projection portions 26*a* and 26*b* are configured to come into contact by surface with the opposed surface 23*a* of the reinforcement member 23. To obtain the foregoing advantage in a more reliable manner, the two projection portions 26*a* and 26*b* may be configured to come into contact by line (or in a similar form) with the opposed surface 23*a* of the reinforcement member 23.

As described above, in the first embodiment, the relation between the length A of the nip portion and the length B of the abutment portion between the stationary member 26 and the reinforcement member 23 in the direction of conveyance, and the relation between the ranges of these lengths, are optimized. Accordingly, it is possible to shorten a warm-up time and a first print time, and does not cause a fixing error or the like even if the device is operated at a higher speed, and prevent occurrence of a trouble that the stationary member 26 in contact under pressure with the reinforcement member 23 falls down.

In the first embodiment, the fixing belt 21 has a multi-layered structure. Alternatively, the fixing belt may use an endless fixing film made of polyimide, polyamide, fluorine resin, metal, or the like. In this case, it is possible to obtain the same advantages as those in the first embodiment.

Second Embodiment

Figure 7:
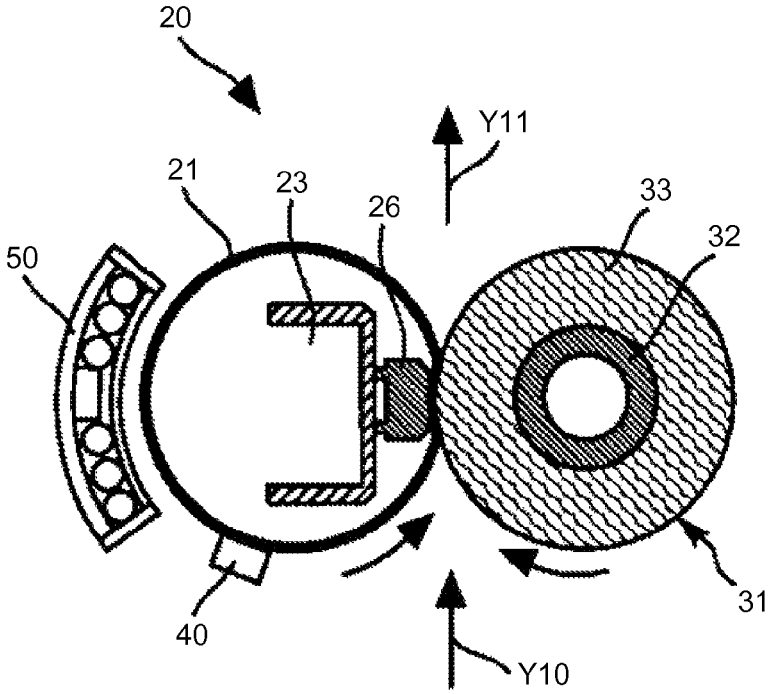
FIG. 7 is a diagram illustrating a configuration of a fixing device in a second embodiment.

Referring to FIG. 7, a second embodiment will be described in detail.

FIG. 7 is a diagram illustrating a configuration of a fixing device in the second embodiment, which is equivalent to FIG. 2 describing the first embodiment. The fixing device in the second embodiment is different from that in the first embodiment in that the fixing belt 21 is heated by electromagnetic induction.

As shown in FIG. 7, the fixing device 20 in the second embodiment includes the fixing belt 21 (belt member), the stationary member 26, the reinforcement member 23, the pressing roller 31 (heating rotational body), the temperature sensor 40, and the like, as in the first embodiment.

In the second embodiment, the nip width is included in the range of the stationary member 26 abutting the reinforcement member 23 in the direction of conveyance (the up-down direction in FIG. 7), as in the first embodiment. Further, the range of the stationary member 26 abutting the reinforcement member 23 in the direction of conveyance is included in the range of the opposed surface 23*a* of the reinforcement member 23 in the direction of conveyance.

The fixing device 20 in the second embodiment is provided with an induction heating unit 50 as a heating unit, instead of the heater 25. The fixing belt 21 in the second embodiment is heated by electromagnetic induction of the induction heating unit 50, unlike the fixing device 20 in the first embodiment heated by radiation heat from the heater 25.

The induction heating unit 50 is formed by an exciting coil, cores, a coil guide, and the like. The exciting coil has a litz wire as a bundle of thin wires extended in the width direction (perpendicular to the plane of paper in which FIG. 7 is provided) to cover a part of the fixing belt 21. The coil guide is made of a resin material with high heat resistance or the like, and holds the exciting coil and cores. The cores are semi-cylinder members formed by a ferromagnetic material such as ferrite (with a relative permeability of about 1000 to 3000), and include a center core and side cores to form an efficient magnetic flux for the fixing belt 21. The cores are opposed to the exciting coil extended in the width direction.

Meanwhile, the fixing belt 21 has, in addition to the base material layer, the elastic layer, and the release layer described above in relation to the first embodiment, a heat-generation layer heated by electromagnetic induction of the induction heating unit 50 (the heat-generation layer may be formed between the elastic layer and the release layer or the base material layer may be used as a heat-generation layer, for example). Material for the heat-generation layer may be nickel, stainless steel, iron, copper, cobalt, chrome, aluminum, gold, platinum, silver, tin, palladium, or an alloy of two or more of the foregoing metals, or the like.

The fixing device 20 thus configured operates as described below.

When the fixing belt 21 is driven and rotated in a direction of arrow in FIG. 7, the fixing belt 21 is heated at a position opposed to the induction heating unit 50. Specifically, when a high-frequency alternating current is flown to the exciting coil, magnetic lines of force are formed around the fixing belt 21 so as to alternately switch in two directions. At that time, an eddy current is generated on the surface of the heat-generation layer of the fixing belt 21, and Joule heat is generated by electric resistance of the heat-generation layer. The heat-generation layer is heated by electromagnetic induction with the Joule heat, thereby to heat the fixing belt 21.

To efficiently heat the fixing belt 21 by electromagnetic induction, the induction heating unit 50 is preferably opposed to the entire peripheral area of the fixing belt 21.

As described above, in the second embodiment, the relation between the length A of the nip portion and the length B of the abutment portion between the stationary member 26 and the reinforcement member 23, and the relation between the ranges of the lengths, are optimized as in the foregoing embodiment. Accordingly, it is possible to shorten a warm-up time and a first print time, and does not cause a fixing error or the like even if the device is operated at a higher speed, and prevent occurrence of a trouble that the stationary member 26 in contact under pressure with the reinforcement member 23 falls down.

In the second embodiment, the fixing belt 21 is heated by electromagnetic induction heating, but the fixing belt 21 may be heated by application of heat from a resistance heating element. Specifically, the resistance heating element is brought into abutment with the partial or entire inner peripheral surface or outer peripheral surface of the fixing belt 21. The resistance heating element is a planar heating element such as a ceramic heater, and is connected at both end portions to a power source unit. When an electric current is flown into the resistance heating element, the resistance heating element is raised in temperature due to electric resistance of the resistance heating element, thereby to heat the abutting fixing belt 21.

In such a case, can be optimized the relations among the length A of the nip portion, the length B of the abutment portion between the stationary member 26 and the reinforcement member 23, and the length C of the opposed surface 23*a* of the reinforcement member 23, and the relations among the ranges of these lengths, so as to obtain the same advantages as those in the second embodiment.

In the embodiment, a relation between the length of the nip portion and the length of an abutment portion between the stationary member and the reinforcement member, and a relation between the ranges of the lengths, are optimized. Accordingly, it is possible to provide a fixing device that has a short warm-up time and a short first print time, does not cause a fixing error or the like even if the device is operated at a higher speed, and does not allow the stationary member in contact under pressure with the reinforced member to fall down, and an image forming device.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A fixing device comprising:

an endless fixing belt that runs in a set direction, heats and melts a toner image, and has flexibility;

a stationary member that is set stationary on an inner peripheral surface side of the fixing belt and is in contact under pressure with a pressing rotational body via the fixing belt to form a nip portion to which a recording medium is conveyed; and a reinforcement member that is set stationary on the inner peripheral surface side of the fixing belt and is in abutment with the stationary member from inside of the fixing belt to reinforce the stationary member, wherein if a length of the nip portion in a direction of conveyance of the recording medium is designated as A and a length between an upstream-side abutment portion at which the stationary member and the reinforcement member are in abutment with each other on the upstream side of the direction of conveyance and a downstream-side abutment portion at which the stationary member and the reinforcement member are in abutment with each other on the downstream-side of the direction of conveyance is designated as B, following relation is established:

$$A < B, \text{ and}$$

a range of the nip portion in the direction of conveyance falls within a range between the upstream-side abutment portion and the downstream-side abutment portion, and wherein if a length of an opposed surface of the reinforcement member opposed to the stationary member in the direction of conveyance is designated as C, the following relation is established:

$$B < C, \text{ and}$$

the range between the upstream-side abutment portion and the downstream-side abutment portion in the direction of conveyance falls within a range of the opposed surface of the reinforcement member, and the stationary member is provided with an upstream-side projection portion that projects toward the opposed surface of the reinforcement member to form the upstream-side abutment portion; and a downstream-side projection portion that projects toward the opposed surface of the reinforcement member to form the downstream-side abutment portion.

2. The fixing device according to claim 1, wherein the stationary member and the reinforcement member are symmetrically aligned with respect to a virtual straight line passing through the center of the nip portion in the direction of conveyance and orthogonal to the direction of conveyance, as seen in a cross section orthogonal to a width direction thereof.

3. The fixing device according to claim 1, further comprising:

a holding member configured to hold both end portions of the fixing belt in a width direction; and a heating unit configured to be opposed to or in contact with the fixing belt to heat the fixing belt, wherein the reinforcement member has standing portions standing with the same length in a direction separated from the opposed surface, on the upstream and downstream sides of the direction of conveyance, respectively, and the two standing portions abut the holding member to hold the reinforcement member.

4. An image forming device comprising the fixing device according to claim 1.

5. The fixing device according to claim 1, wherein the upstream-side projection portion and the downstream-side projection portion are in contact with the opposed surface of the reinforcement member at only two locations.

6. The fixing device according to claim 5, wherein a space is provided between the stationary member having the upstream-side projection portion and the downstream-side projection and the opposed surface of the reinforcement member.

7. The fixing device according to claim 5, wherein the stationary member is covered with a sheet-like plate made of a low-friction material to reduce sliding resistance with respect to the endless fixing belt.

8. The fixing device according to claim 7, wherein the sheet-like member has a plurality of hole portions that fits to the upstream-side projection portion and the downstream-side projection portion.

9. The fixing device according to claim 8, wherein the sheet-like member has a plurality of screw portions to fit screws therein.

10. The fixing device according to claim 8, wherein the sheet-like member is attached to the stationary member at peripheral areas of the stationary member except at areas of the upstream-side projection portion and the downstream-side projection.

11. The fixing device according to claim 8, wherein the sheet-like member has a rectangular shape when being developed as a single component.

12. The fixing device according to claim 11, wherein when covering the stationary member, the sheet-like member has both rectangular ends folded and doubled between the upstream-side projection portion and the downstream-side projection portion to form an overlapping portion.

13. The fixing device according to claim 12, wherein the sheet-like member is fixed by a plurality of screws to the stationary member so as to sandwich the overlapping portion of the sheet-like member between the stationary member and the sheet-like member.

14. The fixing device according to claim 1, wherein the reinforcement member has both end portions in a width direction held by holding members of the fixing device.

15. The fixing device according to claim 1, wherein the reinforcement member further includes a reflection member to heat the reinforcement member.

16. The fixing device according to claim 15, wherein the reflection member is provided with at least one of a mirror finish and a heat insulating material.

17. The fixing device according to claim 15, wherein the reflection member is opposed to a heater.

18. The fixing device according to claim 1, further comprising:

a heater, wherein the reinforcement member is disposed between the heater and the stationary member.

19. The fixing device according to claim 18, wherein the reinforcement member is between the heater and the upstream-side projection portion and the downstream-side projection portion of the stationary member so that the reinforcement member faces the upstream-side projection portion and the downstream-side projection portion.

20. A fixing device comprising:

a flexible endless fixing belt;

a stationary member that is fixed on an inner peripheral surface side of the fixing belt and is in contact under pressure with a pressing rotational body via the fixing belt to form a nip portion to which a recording medium is conveyed; and a reinforcement member that is fixed on an inner peripheral surface side of the fixing belt and is in abutment with the stationary member from inside of the fixing belt to reinforce the stationary member, wherein the reinforcement member includes, an opposed portion that forms an opposed surface opposed to the stationary member, and projecting portions formed respectively on an upstream side and a downstream side of the opposed portion in a direction of conveyance of the recording medium, the projecting portions extending in a direction which the projecting portions are separated from the pressing rotational body, the stationary member includes an abutment portion on a side thereof which is in abutment with the reinforcement member, and a following relation is established:

$$A < B < C, \text{ where}$$

a length of the nip portion in the direction of conveyance is designated as A, a length of the abutment portion from the upstream side to the downstream side in the direction of conveyance is designated as B, and a length of the opposed portion of the reinforcement member opposed to the stationary member in the direction of conveyance is designated as C.

21. The fixing device according to claim 20, wherein the abutment portion includes a plurality of projecting portions.

* * * * *